US010782069B2

(12) United States Patent
Bloemendaal et al.

(10) Patent No.: US 10,782,069 B2
(45) Date of Patent: Sep. 22, 2020

(54) EQUILIBRIUM MOISTURE GRAIN DRYING WITH HEATER AND VARIABLE SPEED FAN

(71) Applicant: CTB, Inc., Milford, IN (US)

(72) Inventors: Brent J. Bloemendaal, Zionsville, IN (US); Ross Alan Mielke, Westfield, IN (US); Morgen Benner, Lafayette, IN (US)

(73) Assignee: CTB, Inc., Milford, IN (US)

( * ) Notice: Subject to any disclaimer, the term of this patent is extended or adjusted under 35 U.S.C. 154(b) by 359 days.

(21) Appl. No.: 14/718,566

(22) Filed: May 21, 2015

(65) Prior Publication Data

US 2015/0354895 A1 Dec. 10, 2015

Related U.S. Application Data

(60) Provisional application No. 62/010,229, filed on Jun. 10, 2014.

(51) Int. Cl.
*F26B 3/00* (2006.01)
*F26B 21/10* (2006.01)
(Continued)

(52) U.S. Cl.
CPC ..... *F26B 21/10* (2013.01); *F26B 3/06* (2013.01); *F26B 9/063* (2013.01); *F26B 17/00* (2013.01); *F26B 21/12* (2013.01); *F26B 2200/06* (2013.01)

(58) Field of Classification Search
CPC ..... F26B 21/06; F26B 21/08; F26B 21/10; F26B 21/12; F26B 23/00; F26B 2200/06; F26B 2200/08
See application file for complete search history.

(56) References Cited

U.S. PATENT DOCUMENTS 4,037,527 A 7/1977 Steffen
4,281,489 A 8/1981 Kallestad et al.
(Continued)

FOREIGN PATENT DOCUMENTS

AR 086635 A1 1/2014
CA 2224819 A1 1/1997
(Continued)

OTHER PUBLICATIONS

"Resistance to Airflow of Grains, Seeds, Other Agricultural Products, and Perforated Metal Sheets"; pp. 528-538; Mar. 1996; ASAE Standards 1998.
(Continued)

*Primary Examiner* — Jason Lau
(74) *Attorney, Agent, or Firm* — Harness Dickey

(57) ABSTRACT

A grain drying system and process includes a controller that is electronically coupled to a variable speed fan and to a heater or a heat pump to supply air through a plenum and the grain. Also coupled to the controller are ambient temperature and humidity sensors, internal plenum temperature and a humidity sensor. The controller adjusts a fan speed in combination with operating the heater or heat pump to deliver a target equilibrium moisture temperature, during a first period when the ambient air is outside the equilibrium moisture target. The controller operates the fan at a minimum speed, during a second period when the ambient air is outside the equilibrium moisture target, and the controller is unable to obtain equilibrium moisture target air in the plenum in view of operational limits of the fan and the heater or heat pump.

39 Claims, 10 Drawing Sheets

EQUILIBRIUM MOISTURE VALUES
MOISTURE CONTENT (% WET BASIS) FOR CROPS EXPOSED TO AIR AT VARIOUS TEMPERATURES AND RELATIVE HUMIDITIES

| | RELATIVE HUMIDITY | | | | | | | | | | | |
|---|---|---|---|---|---|---|---|---|---|---|---|---|
| | 20 % | | | 40 % | | | 60 % | | | 80 % | | |
| TEMP ( F) | C | W | SB | C | W | SB | C | W | SB | C | W | SB |
| 40 | 9.2 | 8.5 | 4.6 | 11.9 | 11.7 | 8.1 | 14.5 | 14.6 | 11.5 | 17.9 | 18.0 | 16.0 |
| 50 | 8.5 | 8.2 | 4.2 | 11.2 | 11.3 | 7.8 | 13.8 | 14.2 | 11.2 | 17.3 | 17.4 | 15.7 |
| 60 | 7.9 | 7.9 | 3.9 | 10.6 | 11.0 | 7.5 | 13.3 | 13.7 | 11.0 | 16.8 | 16.9 | 15.4 |
| 70 | 7.3 | 7.7 | 3.6 | 10.0 | 10.7 | 7.2 | 12.7 | 13.3 | 10.7 | 16.3 | 16.5 | 15.2 |
| 80 | 6.7 | 7.5 | 3.3 | 9.6 | 10.4 | 6.9 | 12.3 | 13.0 | 10.4 | 15.9 | 16.0 | 15.0 |

[C = SHELLED YELLOW DENT CORN; W = HARD RED SPRING WHEAT; SB = SOYBEANS]
COPYRIGHT © 2002, REGENTS OF THE UNIVERSITY OF MINNESOTA. ALL RIGHTS RESERVED. MAY 2002/FS-M1080

(51) Int. Cl.

| | |
|---|---|
| ***F26B 3/06*** | (2006.01) |
| ***F26B 9/06*** | (2006.01) |
| ***F26B 17/00*** | (2006.01) |
| ***F26B 21/12*** | (2006.01) |

(56) References Cited

U.S. PATENT DOCUMENTS

| | | | | |
|---|---|---|---|---|
| 4,306,490 | A | 12/1981 | Kallestad | |
| 4,522,335 | A | 6/1985 | Kallestad et al. | |
| 4,583,300 | A | 4/1986 | Mast | |
| 4,599,809 | A | 7/1986 | Parkes | |
| 4,688,332 | A | 8/1987 | Kallestad et al. | |
| 4,896,795 | A | 1/1990 | Ediger et al. | |
| 4,930,229 | A | 6/1990 | Moser | |
| 5,716,272 | A | 2/1998 | Nelson | |
| 5,893,218 | A | 4/1999 | Hunter et al. | |
| 6,405,453 | B1 * | 6/2002 | Salameh | D06F 58/28 34/491 |
| 6,530,160 | B1 | 3/2003 | Gookins | |
| 7,004,401 | B2 | 2/2006 | Kallestad | |
| 7,240,029 | B2 | 7/2007 | Kallestad | |
| 7,243,857 | B2 | 7/2007 | Kallestad | |
| 7,472,070 | B2 | 12/2008 | Kallestad | |
| 8,806,772 | B1 | 8/2014 | Schaefer, Jr. | |
| 2003/0033057 | A1 * | 2/2003 | Kallestad | A01F 25/22 700/277 |
| 2003/0079365 | A1 | 5/2003 | Corak et al. | |
| 2003/0214310 | A1 | 11/2003 | McIntosh | |
| 2005/0080567 | A1 | 4/2005 | Wieting et al. | |
| 2006/0100745 | A1 | 5/2006 | Kallestad | |
| 2006/0108434 | A1 | 5/2006 | Kallestad | |
| 2009/0211110 | A1 | 8/2009 | Bartol | |
| 2010/0229420 | A1 | 9/2010 | Garrido et al. | |
| 2010/0256822 | A1 | 10/2010 | Kallestad | |
| 2013/0015251 | A1 | 1/2013 | Bloemendaal et al. | |
| 2014/0043048 | A1 | 2/2014 | Bloemendaal et al. | |
| 2014/0046611 | A1 | 2/2014 | Bloemendaal et al. | |
| 2014/0360045 | A1 * | 12/2014 | Bartosik | F26B 21/08 34/474 |
| 2015/0354889 | A1 | 12/2015 | Hunter | |

FOREIGN PATENT DOCUMENTS

| | | | |
|---|---|---|---|
| CN | 2113959 | U | 8/1992 |
| CN | 201649757 | U | 11/2010 |
| EP | 2718648 | A1 | 4/2014 |
| GB | 2 245 976 | A | 1/1992 |
| IN | 1455/KOL/2010 | | 3/2011 |
| JP | H0490488 | A | 3/1992 |
| WO | 2010/053090 | A1 | 5/2010 |
| WO | 2012/085926 | A1 | 6/2012 |
| WO | 2012/170408 | A1 | 12/2012 |

OTHER PUBLICATIONS

"Management of Stored Grain With Aeration—Airflow and Equipment"; Revised 1991.

S.J. Ray, L.O. Pordesimo, LR. Wilhelm; "Airflow Resistance of Some Pelleted Feed"; vol. 47(2): pp. 513-519; "Transactions of the ASAE"; © 2004 American Society of Agricultural Engineers ISSN 0001-2351.

S.O. Jekayinfa; "Effect of Airflow Rate, Moisture Content and Pressure Drop on the Airflow Resistance of Locust Bean Seed"; May 2006; Agricultural Engineering International; the CIGR Ejournal. Manuscript FP 06 010. vol. VIII.

D. Garg, D.E. Maier; "Modeling non-uniform airflow distribution in large grain silos using Fluent", pp. 754-762; 9$^{th}$ International Working Conference on Stored Product Protection, Oct. 15-18, 2006, Sao Paulo, Brazil (http://spiru.cgahr.ksu.edu/proj/iwcspp/iwcspp9.html).

"DS36C280 Slew Rate Controlled CMOS EIA-RS-485 Transceiver"; © 2004 National Semiconductor Corporation; Texas Instruments; Literature No. SNLS097B; Jul. 2000.

BinManager LIT; GSI Total Value, Total Systems; GS-040 Oct. 2009; © 2009 by GSI Group, LLC.

"Complete Grain Management with BinManager"; IntelliAir, BinManager, (unknown original publication date, but downloaded from the internet prior to Aug. 8, 2012).*.

"Grain Moisture Measurement with Capacitance Type Devices"; AgriChem, Inc.; Oct. 21, 1994.

R.B. McIntosh, M.E. Casada; "Fringing Field Capacitance Sensor for Measuring the Moisture Content of Agricultural Commodities"; IEEE Sensors Journal, vol. 8, No. 3, Mar. 2008.

M.E. Casada, P.R. Armstrong; "Wheat Moisture Measurement with a Fringing field Capacitive Sensor"; vol. 52(5): 1785-1791; © 2009 American Society of Agricultural and Biological Engineers ISSN 0001-2351.

M.E. Casada, P.A. Armstrong; "Wheat Moisture Measurement with a Fringing Field Capacitive Sensor"; An ASABE Meeting Presentation; Paper No. 085207; Jun. 29, 2008.

W.C. Wang, Y.Z. Dai; "A Grain Moisture Detecting System Based on Capacitive Sensor"; International Journal of Digital Content Technology and its Applications; vol. 5, No. 3; Mar. 2011.

"PIC16F5X Data Sheet, Flash-Based, 8-Bit CMOS Microcontroller Series"; © 2004 Microchip Technology Inc.; DS41213C-p. ii-88; Sep. 27, 2004.

"Introducing OPI-Integris moisture", Jul. 1, 2011 (Jul. 1, 2011), XP055082579 (whole document) URL:http://www.grainsystems.ca/documents/moisture cable.pdf.

OPI Systems: "Advanced Grain Management", 2011, pp. 1-65, XP002714203, Retrieved from the Internet: URL:http://www.sirajsons.pk/OPI-Integris%20Presentation.pdf, pp. 25,26,31.

"Temperature in grain stores and silos Duoline soft", Feb. 1, 2010 (Feb. 1, 2010), XP055082270, Retrieved from the Internet: URL:http://www.euromac.fr/wp-content/uploads/2010/02/Prospekt-DLS-soft-en-web.pdf, the whole document.

"SafeTrack Grain Temperature Monitoring System Monitor Your Grain, Anytime, Anywhere.", Apr. 30, 2012 (Apr. 30, 2012), XP055082567, Retrieved from the Internet: URL:http://safegrain.com/wp-content/uploads/2012/05/SafeTrack-Brochure.pdf, the whole document.

Erik Flojgaard Kristensen et al: Quality Control in Grain Stores by Use of In Bedded Wireless Sensors', Int. Conf. Agricol. Eng., Jul. 12, 2012 (Jul. 12, 2012), XP-55082600, the whole document.

"Grain Watch-", Nov. 3, 2008 (Nov. 3, 2008), pp. 1-2, XP055082542, URL:http://www.liroselectronic.com/gw/documents/GWdatablad20081103ru.pdf, the whole document.

Shinghal et al., "Intelligent Humidity Sensor For—Wireless Sensor Network Agricultural Application", International Journal of Wireless & Mobile Networks (IJWMN), vol. 3, No. 1, Feb. 2011, p. 118-128.

Paul E. Sumner, "Natural Air Drying Corn", University of Georgia, Biological and Agricultural Engineering Department, Mis. Pub. No. ENG07-04, Oct. 2007, http://www.caes.uga.edu/commodities/fieldcrops/gagrains/postharvest/documents/Natural%20Air%20Drying.pdf.

William F. Wilcke—Associate Professor and Extension Engeineer; R. Vance Morey—Professor and Head of Department of Biosystems and Agricultural Engineering, University of Minnesota College of Agricultural, Food, and Environmental Sciences, "Corn Production; Natural-Air Corn Drying in the Upper Midwest", Copyright © 2009 Regents of the University of Minnesota. WW-6577-GO 1995; Review 2009. http://conservancy.umn.edu/bitstream/handle/11299/53021/6577.pdf?sequence=1&isAllowed=y.

Office Action dated Dec. 17, 2018 in corresponding Hungary Patent Application No. P 15 00272, with English translation.

First Examination Report dated Apr. 18, 2019 in corresponding India Patent Application No. 2076/MUM/2015, including English translation.

Paul Sumner; "Harvesting and Drying Corn"; A Guide to Corn Production in Georgia, University of Georgia, 2013, pp. 76-86, retrieved from the internet at http://www.uaex.edu/publications/PDF/MP297/9 storage.pdf on Jul. 28, 2011.

Dennis R. Gardisser; "9—On Farm Storage and Drying"; Grain Sorghum Production Handbook, University of Arkansas, Current, pp. 55-60, retrieved from the internet at http://search.uaex.edu/

(56) References Cited

OTHER PUBLICATIONS search?g=on+farm+storage+and+drying&site=default collection &client=uaex&proxystylesheet=uaex prior to Aug. 8, 2012.
"Temperatur Überwachungssysteme", Nov. 12, 2001 (Nov. 12, 2001), XP055082188, retrieved from the internet at URL:http://supertech.dk/images/Newpdf/AGROLOGbrochureDE.pdf, the whole document., with English translation retrieved from the internet at http://supertechagroline.com/wp-content/uploads/2015/10/AGROLOGbrochureWEB.pdf on Jan. 19, 2018.
Karl VanDevender, Professor-Extension Engineer, University of Arkansas Division of Agriculture, Research & Extension, Agriculture and Natural Resources, "Grain Drying Concepts and Options", FSA1072, retrieved from the internet at http://www.uaex.edu/publications/PDF/FSA-1072.pdf on May 20, 2014.
Samy Sadaka, Assistant Professor—Extension Engineer; Rusty Bautista—Instructor, Biological and Agricultural Engineering, University of Arkansas Division of Agriculture, Research & Extension, Agriculture and Natural Resources, "Grain Drying Tools: Equilibrium Moisture Content Tables and Psychometric Charts", FSA1074, retrieved from the internet at http://www.uaex.edu/publications/PDF/FSA-1072.pdf on May 20, 2014.
Sam McNeill, PhD, PE—Extension Agricultural Engineer, UK Research and Education Center, University of Kentucky College of Agriculture, Department of Biosystems and Agricultural Engineering, "Equilibrium Moisture Content for Grains", retrieved from the internet at https://jokko.bae.uky.edu/ext/Grain Storage/PDFs/EquilibriumMoistureContentforGrains.pdf on May 20, 2014.

* cited by examiner

EQUILIBRIUM MOISTURE VALUES
MOISTURE CONTENT (% WET BASIS) FOR CROPS EXPOSED TO AIR AT VARIOUS TEMPERATURES AND RELATIVE HUMIDITIES

| | RELATIVE HUMIDITY | | | | | | | | | | | |
|---|---|---|---|---|---|---|---|---|---|---|---|---|
| | 20 % | | | 40 % | | | 60 % | | | 80 % | | |
| TEMP ( F) | C | W | SB | C | W | SB | C | W | SB | C | W | SB |
| 40 | 9.2 | 8.5 | 4.6 | 11.9 | 11.7 | 8.1 | 14.5 | 14.6 | 11.5 | 17.9 | 18.0 | 16.0 |
| 50 | 8.5 | 8.2 | 4.2 | 11.2 | 11.3 | 7.8 | 13.8 | 14.2 | 11.2 | 17.3 | 17.4 | 15.7 |
| 60 | 7.9 | 7.9 | 3.9 | 10.6 | 11.0 | 7.5 | 13.3 | 13.7 | 11.0 | 16.8 | 16.9 | 15.4 |
| 70 | 7.3 | 7.7 | 3.6 | 10.0 | 10.7 | 7.2 | 12.7 | 13.3 | 10.7 | 16.3 | 16.5 | 15.2 |
| 80 | 6.7 | 7.5 | 3.3 | 9.6 | 10.4 | 6.9 | 12.3 | 13.0 | 10.4 | 15.9 | 16.0 | 15.0 |

[C = SHELLED YELLOW DENT CORN; W = HARD RED SPRING WHEAT; SB = SOYBEANS]
COPYRIGHT © 2002, REGENTS OF THE UNIVERSITY OF MINNESOTA. ALL RIGHTS RESERVED. MAY 2002/FS-M1080

FIG 1

EQUILIBRIUM MOISTURE GRAIN DRYING WITH HEATER AND VARIABLE SPEED FAN

CROSS-REFERENCE TO RELATED APPLICATIONS

This application claims the benefit of U.S. Provisional Application No. 62/010,229, filed on Jun. 10, 2014. The entire disclosure of the above application is incorporated herein by reference.

FIELD

The present disclosure relates to processes, systems, and apparatus for grain drying using equilibrium moisture air.

BACKGROUND

This section provides background information related to the present disclosure which is not necessarily prior art.

Grain in a grain bin can be aerated or partially dried or conditioned within a grain bin. This can be done using equilibrium moisture principles. The temperature and relative humidity of air equilibrates to a corresponding grain moisture content if exposed to that temperature and relative humidity air for a sufficient amount of time. The equilibrium moisture values are different for different grains. FIG. 1 provides a representative chart of equilibrium moisture values.

Thus, grain can be aerated or conditioned while stored in a grain bin when the air is at an equilibrium moisture value or range that corresponds to the desired grain moisture content. Unfortunately, the temperature and relative humidity of the ambient air varies throughout the year (FIG. 2), and even throughout a 24 hour period (FIG. 3). Typically, when air is outside of the desired equilibrium moisture values, the grain bin fan is turned off to wait until the ambient air returns to the desired equilibrium moisture values. This results in the fan cycling on and off throughout the day, weeks, and months.

Sometimes grain storage bins are provided with small heaters to heat the ambient air passing through the fans, which can move ambient air slightly outside the equilibrium moisture values to equilibrium moisture air. This somewhat extends the times at which the grain can be aerated or conditioned. The grain bin fan, however, still cycles on and off throughout the day, weeks, and months.

One problem with the grain bin fan repeatedly cycling off is the failure to aerate or condition the grain, and any drying front stagnates in the grain during such "off" periods. This can mean there is not enough time to fully condition the grain so that it is at the correct moisture content when it is time to go to market. This can also mean that mold or other problems appear at the stagnated drying front or elsewhere in the grain. Thus, the grain can be sold at unfavorable prices, or can spoil so it is not suitable for market at all.

SUMMARY

This section provides a general summary of the disclosure, and is not a comprehensive disclosure of its full scope or all of its features.

In accordance with an aspect of this disclosure, an equilibrium moisture grain drying system includes a grain drying controller electronically coupled to a variable speed fan and to one of a heater and a heat pump associated with an air plenum to supply air through the plenum and through grain in a grain bin. An ambient temperature sensor and an ambient humidity sensor can each be positioned outside the grain bin and electronically coupled to the grain drying controller. An internal plenum temperature sensor and an internal plenum humidity sensor can also each be positioned within the plenum and electronically coupled to the grain drying controller. The grain drying controller includes instructions to adjust a fan speed of the variable speed fan in combination with operation of the one of the heater and heat pump to achieve internal plenum temperature sensor data from the internal plenum temperature sensor corresponding to a target equilibrium moisture temperature during a first period when the sensor data from the ambient sensors indicates ambient air is outside the equilibrium moisture target. The grain drying controller includes instructions to operate the variable speed fan at a predetermined minimum speed during a second period when the sensor data from the ambient sensors indicates ambient air is outside the equilibrium moisture target, and the grain drying controller is unable to obtain air in the plenum within the equilibrium moisture target in view of operational limits of the variable speed fan and the one of the heater and heat pump. When the variable speed fan passes air within the equilibrium moisture target through the plenum and through the grain, the equilibrium moisture grain drying system adjusts the moisture content of grain in the grain bin toward a desired target grain moisture content corresponding to the equilibrium moisture target.

In accordance with another aspect of this disclosure, a process of operating an equilibrium moisture grain drying system is provided. The equilibrium moisture grain drying system includes a grain drying controller coupled to each of a variable speed fan and one of a heater and a heat pump to supply air through an air plenum and through grain in a grain bin, an ambient temperature sensor and an ambient humidity sensor, each positioned outside the grain bin; and an internal plenum temperature sensor and an internal plenum humidity sensor, each positioned within the plenum. The process includes adjusting a fan speed of the variable speed fan in combination with operating the one of the heater and heat pump to achieve internal plenum temperature sensor data from the internal plenum temperature sensor corresponding to a target equilibrium moisture temperature during a first period when the sensor data from the ambient sensors indicates ambient air is outside the equilibrium moisture target. Operating the variable speed fan at a predetermined minimum speed during a second period when the sensor data from the ambient sensors indicates ambient air is outside the equilibrium moisture target, and the grain drying controller is unable to obtain conditioned air in the plenum within the equilibrium moisture target in view of operational limits of the variable speed fan and the one of the heater and heat pump. When the variable speed fan passes air within the equilibrium moisture target through the plenum and through the grain, the moisture content of grain in the grain bin moves toward a desired target grain moisture content corresponding to the equilibrium moisture target.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a representative chart of equilibrium moisture values for three different grains.

Corresponding reference numerals indicate corresponding parts throughout the several views of the drawings.

DETAILED DESCRIPTION

Figure 2:
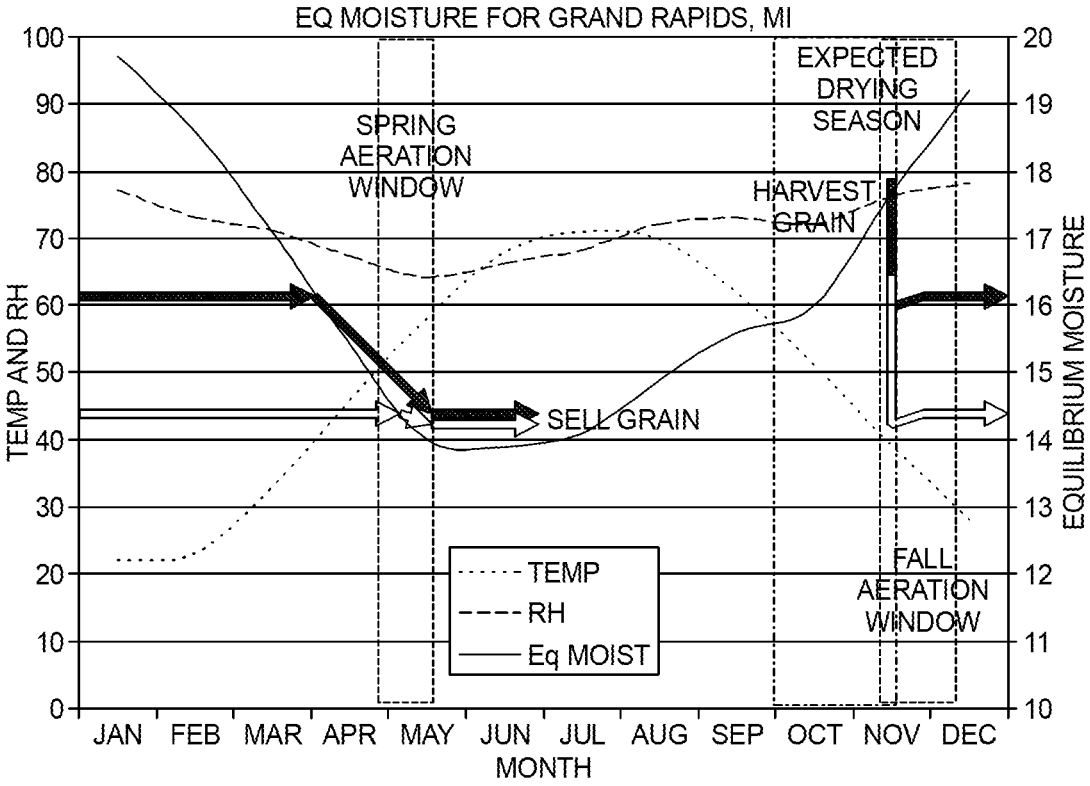
FIG. 2 is a representative chart of equilibrium moisture values over the period of a year.
Figure 3:
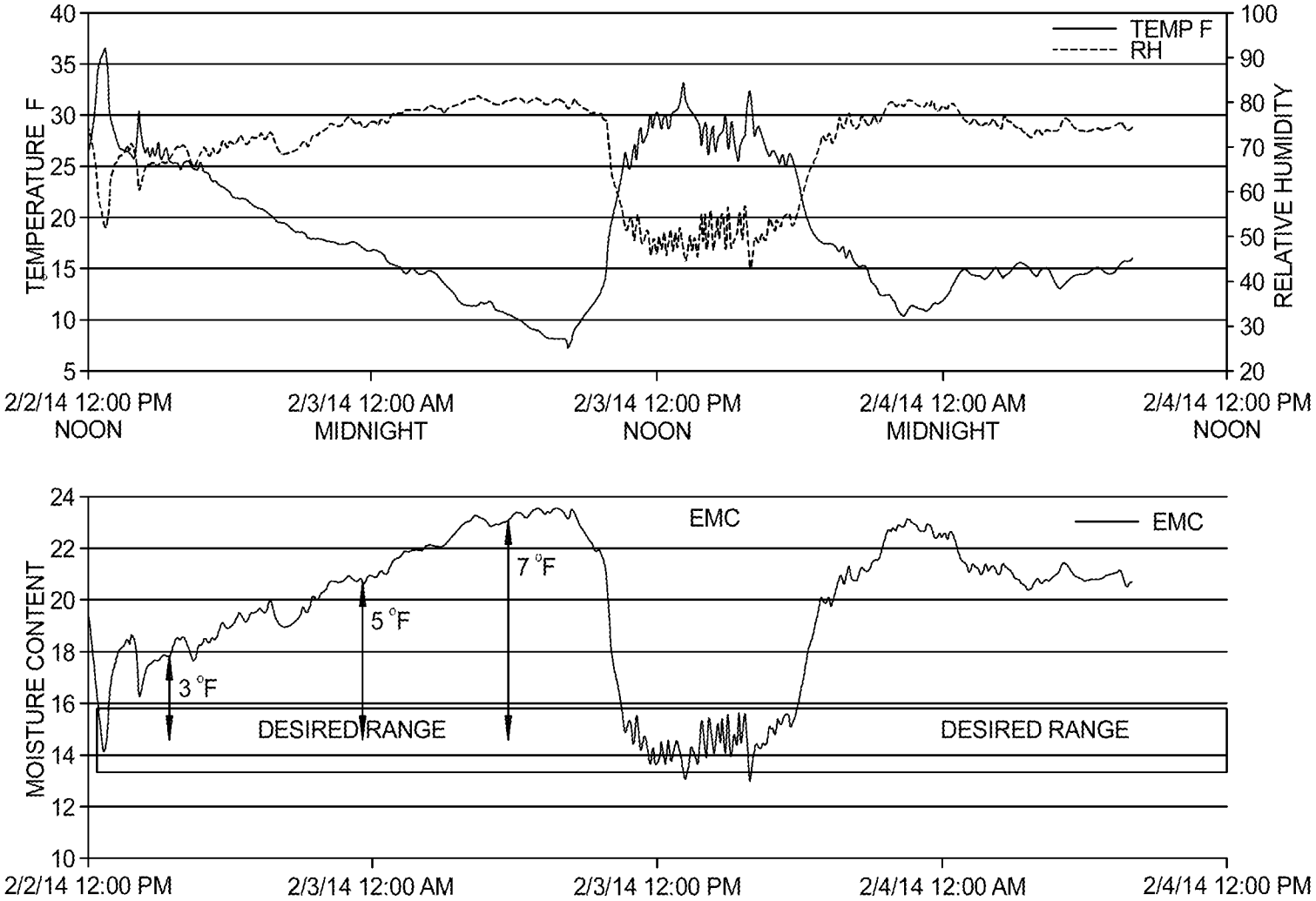
FIG. 3 is a representative chart of equilibrium moisture values over a 48 hour period.

Example embodiments will now be described more fully with reference to the accompanying drawings.

The present technology relates to the aeration of grain bin storage devices, and methods and systems for controlling the same. Aeration of grain bin storage devices is important in maintaining proper moisture levels in order to safely keep grain in storage for a prolonged period of time.

As used herein, a grain bin storage device refers to and includes any large container for storing something in bulk, such as grain, typically found on farms and/or used in commercial agricultural applications. Grain or feed bin storage devices may be any appropriate housing configured for grain or feed storage. They typically include sidewalls and a roof. Such bins can be generally round structures that include a raised floor creating an air plenum beneath the grain or feed. The floor can be perforated so that air can pass from the plenum through the floor and grain to remove moisture from the grain and/or adjust the temperature. Typically, a large number of small perforations is preferred to a smaller number of larger perforations for the same amount of opening in the plenum. Multiple fans can be arranged around the bin to push air into and out of the air plenum.

As used herein, the terms grain and feed, whether used singly or in combination, refer to and include various farm and/or agricultural products and materials useful with the present technology, including as non-limiting examples: all types of grains, seeds, corn, beans, rice, wheat, oats, barley, pods, potatoes, nuts, etc.

Hot air holds more moisture than cold air. Accordingly, air temperature affects the overall water-carrying capacity of the drying air. By way of example, one pound of air at 40° F. can hold about 40 grains of moisture, while one pound of air at 80° F. can hold a four-fold increase of about 155 grains. Relative humidity also plays an important part in the drying process. For example, air at 100° F. and 50% relative humidity can absorb 60 more grains of moisture per pound of air than 100° F. air can at 75% relative humidity. Thus, the amount of moisture to be removed varies with temperature and humidity of the supplied air, as well as the temperature difference of the grain and the supplied air.

Grain within a storage bin will maintain its moisture content and temperature over a period of time due to the semi-isolated environment of the storage bin and the inherent insulative properties of the grain mass. It is known that for a given type of grain, the ambient temperature and relative humidity determine an equilibrium moisture content, which represents the moisture content that the grain will equalize to if exposed for a prolonged period of time to that temperature and relative humidity condition. The equilibrium moisture content can be determined either from a table of known values, or from a mathematical formulation that approximates the data in such a table. The present technology makes this type of information for various grains available through a process controller. Alternatively, this information may be entered by a user, or obtained through various sources using internet communications or the like.

Figure 4:
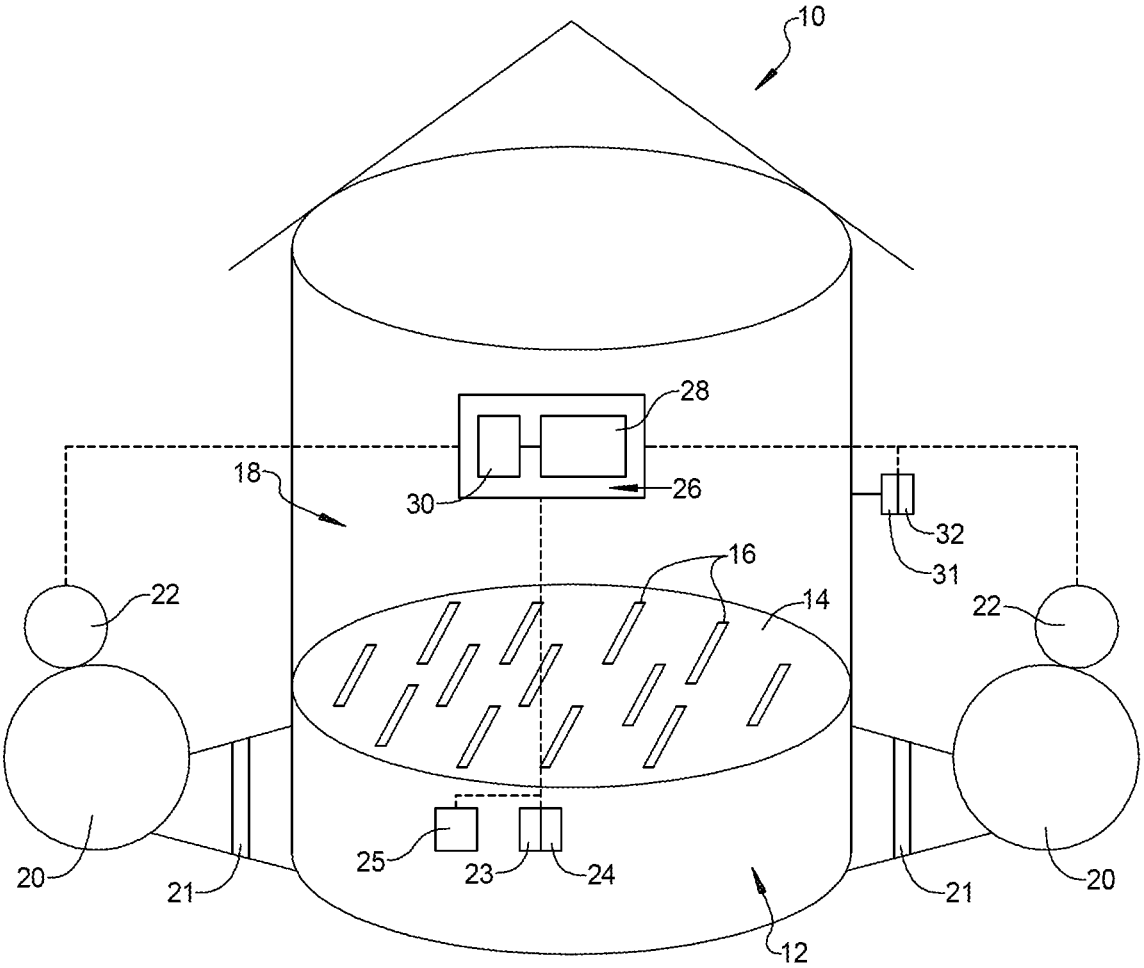
FIG. 4 is a simplified perspective illustration of a grain bin embodying the processes, systems and apparatus of the present disclosure.

Referring to FIG. 4, a system for controlling the aeration of a grain bin storage device includes a grain bin storage device 10, which can include air plenum 12 under grain bin floor 14 having a plurality of apertures or slots 16 through which air may flow from the air plenum 12 into the grain storage area 18 above the floor 14. One or more variable speed ventilation fans 20 can be provided, each fan 20 can have a corresponding variable frequency drive motor 22. A small heater or heat pump 21 can be associated with each fan 20. An internal air temperature sensor 23 and relative humidity sensor 24 is located in the air plenum 12 adjacent the grain bin floor 14. This air plenum 12 in which the temperature sensor 23 and relative humidity sensor 24 is typically located includes the entire airflow path between the fan or fans 20 and the grain mass, and generally ends at about the floor 14 where the air enters the grain mass (not shown). An external temperature sensor 31 and relative humidity sensor 32 is provided outside the grain storage bin to measure the adjacent ambient air.

Figure 5:
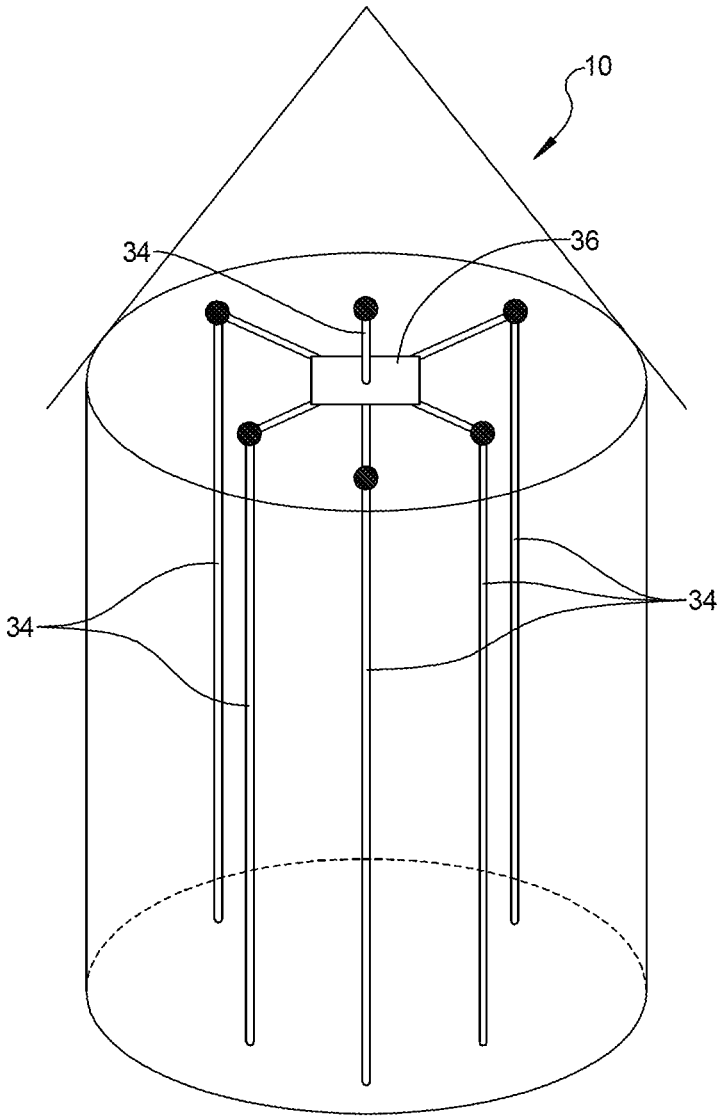
FIG. 5 is a simplified perspective illustration showing the internal moisture cables with temperature and grain moisture sensor nodes within the grain bin of FIG. 4.
Figure 6:
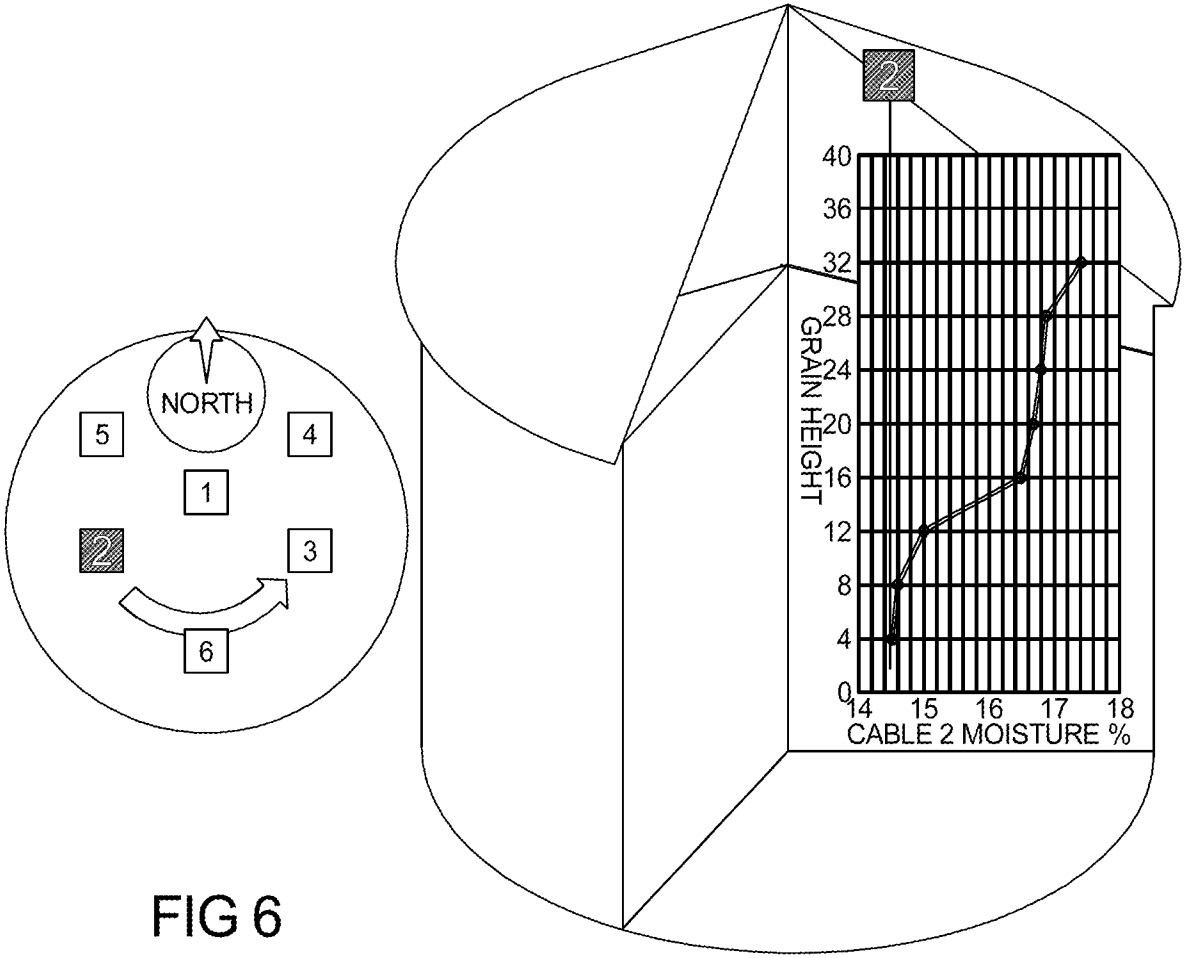
FIG. 6 is a simplified plan illustration showing a controller display representing the internal moisture cables of FIG. 5.

Moisture cables 34 can also be spaced throughout the interior of grain bin 10 as diagramed in FIGS. 5 and 6. It should be appreciated that FIGS. 5 and 6 are diagrammatic representations that have been simplified and illustrated separately from FIG. 4 to improve understanding. Each moisture cable 34 is typically physically suspended from and supported by the roof structure of the grain bin 10. Similarly, data collector 36 associated with grain bin 10 can be provided above the grain storage area, so essentially no downward force is exerted on data collector 36 by grain in grain bin 10. For example, data collector 36 can be mounted to the roof structure outside grain bin 10 or inside grain bin 10 near the top of the roof structure. The moisture cables 36 can include moisture sensors and temperature sensors in nodes spaced along the cables 36. Additional details regarding the moisture cables and sensors and their use can be found in commonly owned patent application Ser. No. 13/569,814 filed Aug. 8, 2012 and published as US2014/0046611 on Feb. 13, 2014, and commonly owned patent application Ser. No. 13/569,804 filed Aug. 8, 2012 and published as US2014/0043048 on Feb. 13, 2014, which are both hereby incorporated herein in their entirety.

A pressure sensor 25 may also be provided in the plenum 12 in order to be able to calculate the actual cubic feet per minute (CFM) of airflow that the fans are moving through the grain. Additional details regarding the use of measuring airflow (CFM) passing through the grain using such a pressure sensor 25 is provided in commonly owned patent application Ser. No. 13/180,797 filed Jul. 12, 2011 and published as US2013/0015251 on Jan. 17, 2013, which is hereby incorporated herein in its entirety.

A processor or controller 26, including electrical circuits in the form of a microprocessor 28 and memory 30, can be configured to receive user input and/or grain bin storage device parameters. Controller 26 is programmed as desired to have certain data (for example in memory 30) and to perform various steps. For example, such programming can include information received by controller 26 into memory from a user or from the manufacturer. Programming may also be provided by the physical design of microprocessor 28 of controller 26, by the use of software loaded into the controller 26, or a combination of hardware and software design.

The controller 26 is also operably coupled to any heater or heat pump 21, internal temperature sensor 23 and relative humidity sensor 24, external temperature sensor 23 and relative humidity sensor 24, any pressure sensor 25, any moisture cables 34 (e.g., via data collector 36), and the variable speed fan motors 22. The coupling of the various components to the controller can, for example, be via any combination of wired or wireless connections.

FIGS. 7-10 depict flow diagrams illustrating various aspects of exemplary systems and methods for controlling aeration of a grain bin storage device. As should be understood, the figures illustrate various embodiments of the present technology and are not to be considered the only representations of the present technology. Certain method boxes illustrate optional steps or processes. It should further be understood that while separate boxes may be illustrated as being separate steps, various embodiments will combine or modify steps or processes, and the combination or omission of certain features, including changing the order of the illustrated steps, are all within the scope of the present disclosure.

Figure 7:
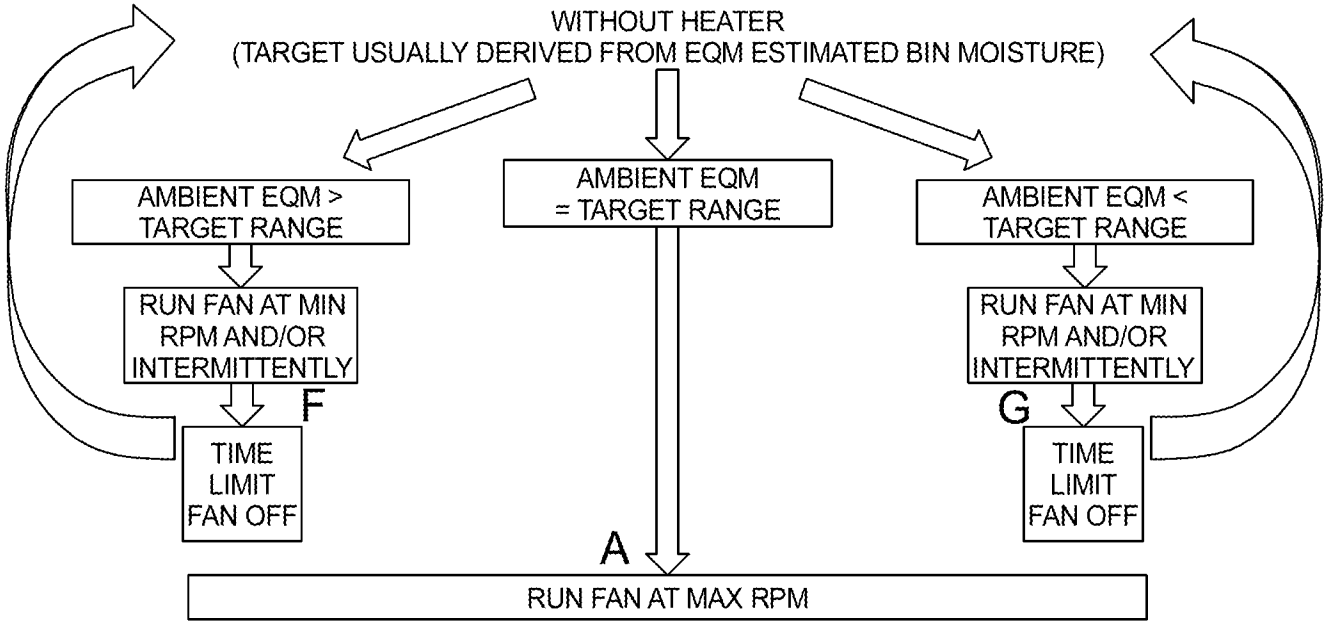
FIG. 7 is a flow diagram of an equilibrium moisture process for such a system including a variable speed fan in accordance with the present disclosure.

Referring to FIG. 7, one exemplary process and system where no heater or heat pump 21 is present generally begins with obtaining user input which can include grain bin storage device parameters. For example, the type of grain in the bin and a target grain moisture content can be input by a user that is converted to a desired range of equilibrium moisture (herein "EQM" or "EMC") via a formula or look-up table in the controller for the inputted type of grain. Alternatively, the user can directly input a desired range of ambient equilibrium moisture (herein "EQM" or "EMC").

The external temperature sensor 31 and humidity sensor 32 provide data or signals to the controller 26, which are converted to a measured EMC of the ambient air at box 100. Again, a formula or look-up table can be used by the controller 26 to make this conversion. If the ambient EMC (or EQM) is within the stored target range as indicated at box 102, then the controller sends a signal causing the fan 20 to operate at maximum speed as indicated at box 104.

If the ambient EMC is greater than the target EMC range, or less than the target EMC range, then the controller sends a signal causing the fan 20 to operate at a minimum speed. This minimum speed can be a set fan or motor revolutions per minute (rpm). For example, the fan may simply be operated at about one-third of the normal full speed. As another option, the controller may be programmed to use the pressure sensor 25 to calculate and operate the fan at a desired or specified minimum or low airflow rate (CFM). For example, the controller can adjust the fan speed to achieve and maintain an airflow rate through the bin of about 5000 CFM.

Another option is for the minimum fan speed to correspond to a desired low or minimum airflow rate per bushel of grain in the grain bin. For example, data or signals from the moisture cables 34 can be used to calculate the amount of grain in the grain bin and the pressure sensor 25 actual airflow rate to determine the actual CFM/Bushel and adjust the fan speed to achieve the desired minimum or low CFM/Bushel as detailed in the previously-identified commonly owned patents. Such a low or minimum CFM/Bushel can be about 0.1 CFM/Bushel, which is typically sufficient to avoid stagnation of the drying front. Alternatively, the minimum CFM/Bushel can be between about 1/14 and 1/7 CFM/Bushel, which is typically sufficient to keep the grain fresh and remove any heat caused by self-heating of the grain.

Figure 8:
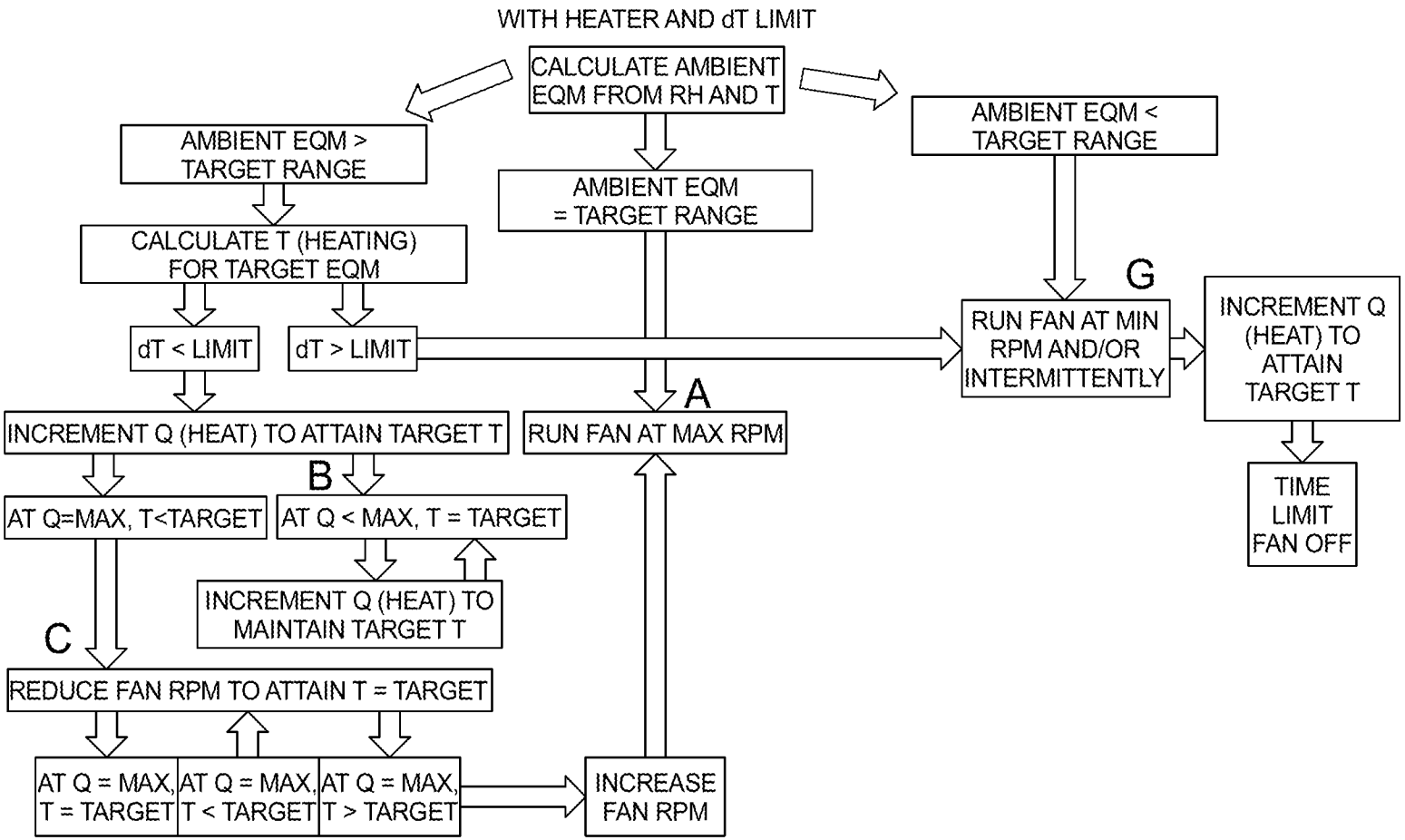
FIG. 8 is a flow diagram of an equilibrium moisture process for such a system including a variable speed fan and a heater in accordance with the present disclosure.

Referring to FIG. 8, one exemplary process and system where a heater 21 is present generally begins with obtaining user input which can include grain bin storage device parameters. In addition to the parameters discussed above, the controller may be programmed with a delta temperature ("dT") range or upper and lower limits. For example, a user might input such dT data, or it may otherwise be preprogrammed or stored in the controller. In some cases, dT can represent the temperature difference between the grain (e.g., as measured using the moisture cables) and the temperature of the air in the plenum. In some cases, dT can represent the temperature difference between the ambient air and the air in the plenum after passing through the heater (or heat pump) 21. In some cases, dT can represent the change in grain temperature. In some cases, more than one or all the dT ranges or limits can be used as limits on the heating (or cooling).

When dT is the difference between the ambient air and the temperature of the grain even though the ambient air EMC is within the target range, if the temperature of the ambient or heated air is, for example, more than 10 degrees F. above the temperature of the grain, the fan would not run. This is in an effort to avoid drastically changing grain temperature during one abnormal day. This check will be done whether heating, cooling, or using ambient air.

Similarly, when dT is the difference in temperature of the grain over a predetermined period resulting from operating the fan, or fan and heater, then for example, if the grain temperature increases more than 10 degrees F. over a 24 hour period, the fan, heater, or both would cease running or return to some minimal state. Again, this is in an effort to avoid drastically changing grain temperature during one abnormal day, and could be done whether heating, cooling, or using ambient air.

dT can also be the temperature difference between the ambient air and the heated air (i.e., the amount of temperature change to the air caused by the heater or cooler). For example, if it is early in the drying process and there is plenty of time left to accomplish the drying target, the controller can be set to only heat/cool the air up to, for example, +/−3 degrees F. to achieve the desired EMC. If the proper conditions for drying do not occur often enough and there is still a significant amount of drying needed, then the limits can be opened up to allow, for example, +/−7 degrees F. or more heating cooling to occur. Similarly, each of the various temperature differential limits discussed above may be set wider to achieve more full-speed run time. Again, each of the various dT ranges or limits can be used alone or in any combination.

The center and right paths of FIG. 8 are similar to those of FIG. 7. Because a heater is present, however, it is possible to aerate or condition the grain when the ambient EMC (or EQM) is above the target range or upper limit. If the calculated or measured dT is less than the dT limit, then heat is incremented in an attempt to attain the target T required to provide EMC air through the grain. Because the heater is generally relatively small, it is possible that it will not be able to heat the air a sufficient amount with the fan running at full speed and the heater operating at maximum. Consequently, the controller can send an instruction or signal or otherwise cause the speed of the fan to decrease, until the target T of the air in the plenum is obtained.

Figure 9:
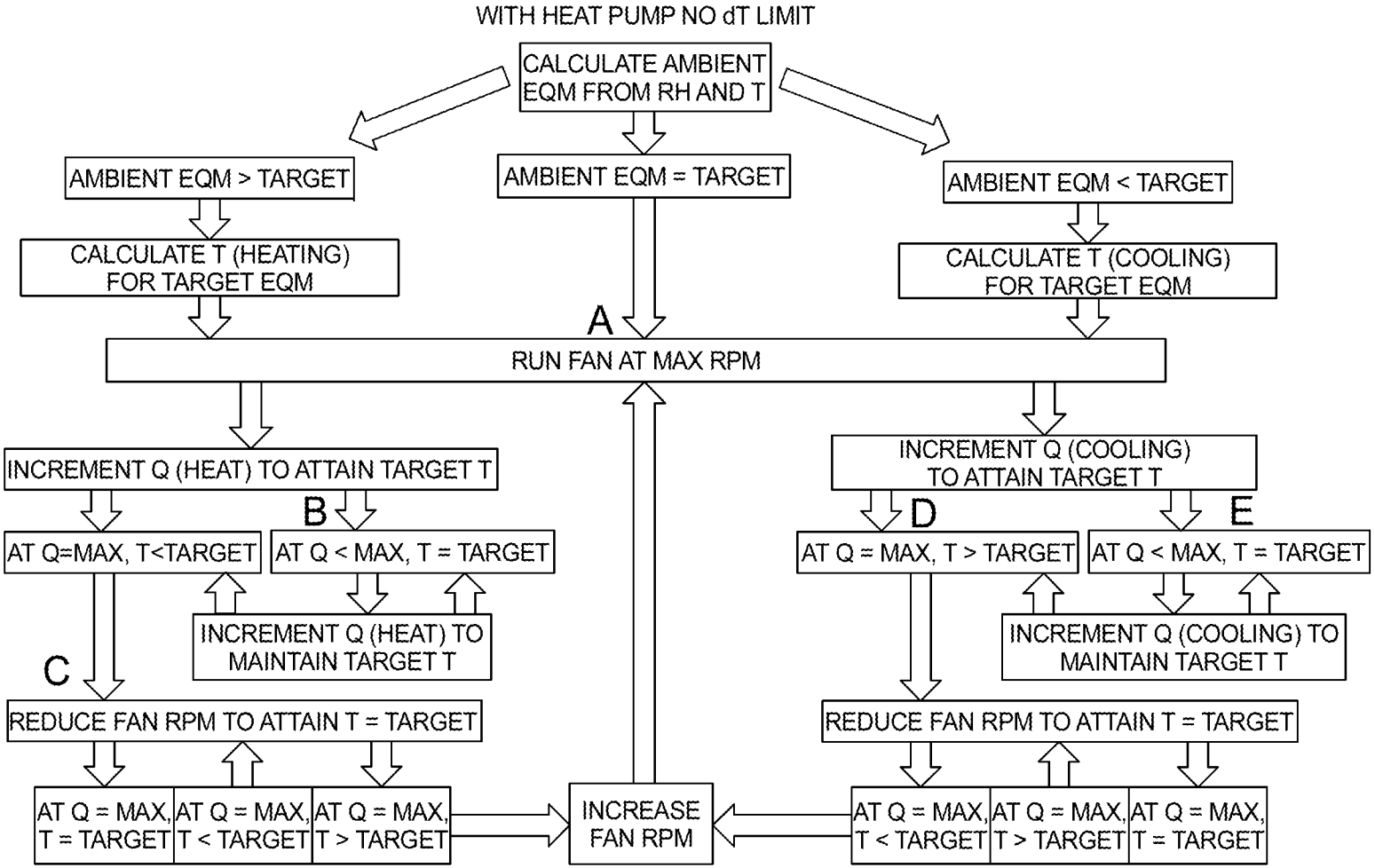
FIG. 9 is a flow diagram of an equilibrium moisture process for such a system including a variable speed fan and a heat pump in accordance with the present disclosure.

Referring to FIG. 9, one exemplary process and system where a heat pump 21 is present allowing the temperature of ambient air to be heated or cooled is illustrated. The various steps and overall process should be evident from FIG. 9 in conjunction with the discussion related to the other examples herein.

Figure 10:
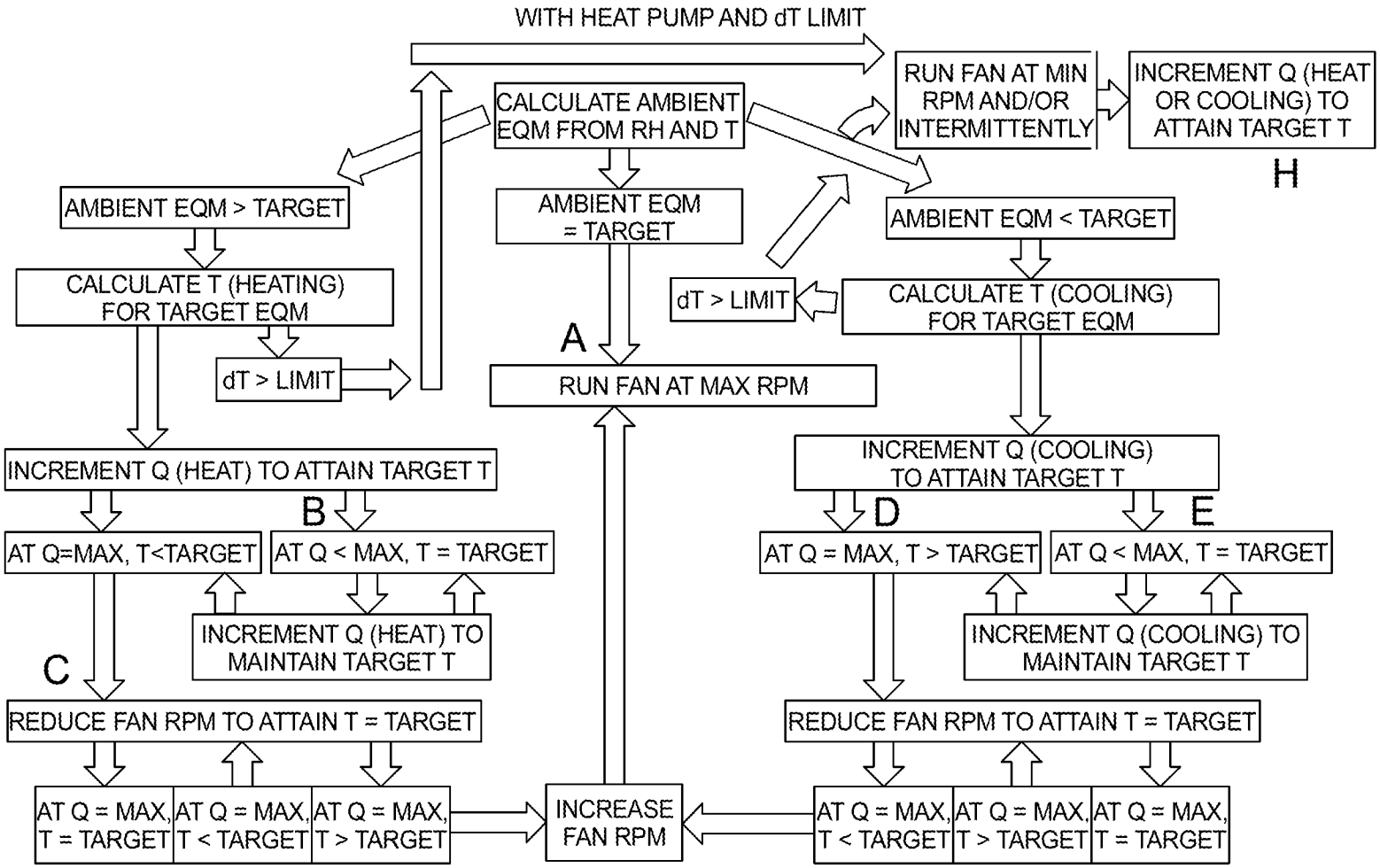
FIG. 10 is an alternative flow diagram of an equilibrium moisture process for such a system including a variable speed fan and a heat pump in accordance with the present disclosure.

Referring to FIG. 10, one exemplary process and system where a heat pump 21 is present (like FIG. 9) and dT range(s) or limits are provided (like FIG. 8) is illustrated. The various steps and overall process should be evident from FIG. 10 in conjunction with the discussion related to the other examples herein.

Examples of various equations or calculations that the controller may use in the processes are provided below.

EXAMPLE STEPS

Without Heater

1. Using (Ambient Temp+Fan Temp Increase) and RH to Find EMC

ASAE D245.5 Moisture Relationships of Plant-based Agricultural Products 6.a RH=1−exp[−A(T+C)($MC_D$)^B]

Where for corn: A=6.6612E-05

B=1.9677

C=42.143

Or 6.b RH=exp[(−A/(T+C)exp(−B($MC_D$))]

Where for corn: A=374.34

B=0.18662

C=31.696

Both equations can be solved for $MC_D$ (Moisture Content on a Dry basis)

2. Convert to Moisture content on a wet basis

Typically, in the grain industry, moisture content is discussed as $MC_w$(Moisture content on a Wet Basis)

$$MC_w=100(MC_D/(100+MC_D))$$

$$\text{Equilibrium Moisture content}=MC_w=\text{EQM}=\text{EMC}$$

In the flowchart, we abbreviated Equilibrium Moisture content as EQM. The industry accepted abbreviation is EMC. We will have used both EMC and EQM interchangeably.

3. Set Limits on EMC of Plenum Air

In this example without a heater, the upper and lower EMC limits within which the fan operates at full speed are set. The plenum air can be measured to insure it is within a certain number of degrees of the grain temp.

Outside those limits, the fan can run at a reduced/minimum CFM or fan speed.

Example Steps

With Heat and Cooling and Heat/Cool Degree Limits (Starting at Step 3)

3. Set limits on EMC of plenum air

If the EMC is within the upper and lower EMC limits, and air temp is within set degrees of grain temperature, we run the fan.

If EMC is above target, heat can be added to raise temp and lower RH of the air. If the EMC of unheated plenum air is 17.0%, heat can be added to bring EMC down to 15%. Because of the nature of equations 6.a and 6.b, it is difficult, but possible to directly solve for the ΔT that the heater needs to add. Alternatively, determining the amount of heat/degrees to add can be done in one of two ways.

a. Increment temperature (T) in equation 6.a by 1 (one) degree. Calculate new RH of the heated air. The new RH can be found in lookup tables, or can be calculated. When air is heated, the partial pressure of the water in it remains constant. The saturation pressure can be estimated by various empirical equations, such as found in F. P. Incropera and D. P. DeWitt, Fundamentals of Heat and Mass Transfer, $4^{th}$ Edition.

The equation is as follows.

$$\rho_{v,s}=\frac{e^{\left(77.345+0.0057\cdot(T_a+273.15)-\frac{7235}{T_a+273.15}\right)}}{(T_a+273.15)^{8.2}}$$

Since we can approximate the new saturation pressure (Pvs) and we know the partial pressure Pp of the water in the air from ambient condition, we can now calculate the new RH.

$$RH=\frac{\text{Partial Pressure}}{\text{Saturation Pressure}}$$

Using the new T and RH for the air, calculate new EMC for the heated air. Continue incrementing T and calculating new RH until EMC is at target. Now the required temperature change has been calculated and heater can target this new temperature.

b. Alternatively, start heating air and measuring plenum T and RH that results. Calculate plenum EMC as T increases and adjust T until EMC reaches target.

Both methods here could work equally well; however, the first enables the controller to determine how much T will be needed without actually heating the air and/or running the fan. This may be particularly desirable if the heat input required exceeds the capacity of the heater or if the temperature increase in degrees exceeds the heat/cool degree limits that were set. This above paragraph summarizes condition B from the flow chart. If the T increase required exceeds the set limit, we will end up at condition H where fan speed will be set at minimum CFM and heater will maintain temperature required to achieve desired EMC.

Back at condition B, if the heat demand from the heater exceeds that which the heater can output, we will instead arrive at condition C.

a. Using method (a) from above, we would determine amount of T increase required to achieve desired EMC. For example, if it takes 6 degrees F. of temperature increase to achieve the desired EMC, that and the estimated or known CFM of the fan can be used to determine btu requirement from the heater.

i. Btu input=1.08*CFM(ΔT)

b. Using method (b), we would simply run the fan and heater and if the heater reaches maximum output before desired EMC is achieved, it is known that we have exceeded output of heater.

In both of these scenarios, if we determine that the heater cannot output the required heat, our next step will be to reduce fan speed. The fan speed will be reduced until heater output is sufficient to achieve proper EMC.

Keep in mind, for all these scenarios we can always be checking that the plenum air temperature is within a set number of degrees of the grain temperature. If it is outside the set range, again, the fan can be operated at the minimum airflow setting.

The conditions noted above are shown in the chart below.

| EMC Status | Requirement | Operation | Condition |
|---|---|---|---|
| EMC within target range | NO heating or cooling required | Run @ max RPM | A |
| EMC above target range | Heating required, but less than limit | Run @ max RPM with required amount of heat | B |
| EMC above target range | Heating required, over heating limit | Run @ reduced cfm to match max heat capacity, or alternatively at some min cfm | C |
| EMC below target range | Cooling required, but less than limit | Run @ max RPM with required amount of cooling | D |
| EMC below target range | Cooling required, over cooling limit | Run @ reduced cfm to match max cooling capacity, or alternatively at some min cfm | E |
| EMC above target range | Heating required but no heater system present | Run @ some min speed | F |
| EMC below target range | Cooling required but no cooling system present | Run @ some min speed | G |
| EMC below target range | Cooling or heating temp change more than dT limit (temp change) | Run @ some min speed | H |

The foregoing description of the embodiments has been provided for purposes of illustration and description. It is not intended to be exhaustive or to limit the disclosure. Individual elements or features of a particular embodiment are generally not limited to that particular embodiment but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An equilibrium moisture grain drying system, comprising:

a grain drying controller electronically coupled to a variable speed fan and to one of a heater and a heat pump associated with an air plenum to supply air through the plenum and through grain in a grain bin;

an ambient temperature sensor positioned outside the grain bin and electronically coupled to the grain drying controller;

an internal plenum temperature sensor positioned within the plenum and electronically coupled to the grain drying controller;

a humidity sensor positioned outside the grain bin or within the plenum and electronically coupled to the grain drying controller;

wherein the grain drying controller is configured to adjust a fan speed of the variable speed fan in combination with operation of the one of the heater and heat pump to achieve a reading from the internal plenum temperature sensor corresponding to a target equilibrium moisture temperature during a first period in which the sensor data from the sensors positioned outside the grain bin indicate ambient air is outside the equilibrium moisture target, and the grain drying system is able to produce air in the plenum within the equilibrium moisture target from the ambient air outside the grain bin;

wherein the grain drying controller is configured to operate the variable speed fan at a predetermined minimum speed to maintain airflow through grain in the grain bin during a second period in which the sensor data from the sensors positioned outside the grain bin indicate ambient air outside the grain bin is outside the equilibrium moisture target, and the grain drying system is unable to produce air in the plenum within the equilibrium moisture target from the ambient air outside the grain bin in view of operational limits of the variable speed fan and the one of the heater and heat pump;

wherein, as the variable speed fan passes air within the equilibrium moisture target through the plenum and through the grain, the equilibrium moisture grain drying system adjusts the moisture content of grain in the grain bin toward a desired target grain moisture content corresponding to the equilibrium moisture target.

2. The equilibrium moisture grain drying system of claim 1, wherein the controller is configured to operate the fan at a predetermined minimum fan speed that is between about 0.07 CFM/Bushel and 1.4 CFM/Bushel of grain capacity in the grain bin.

3. The equilibrium moisture grain drying system of claim 1, further comprising a plurality of grain sensors in sensor nodes along a plurality of vertical cables within grain in the grain bin, wherein the grain sensors are electronically coupled to the grain drying controller, and wherein the grain drying controller is configured to determine an amount of grain in the grain bin based upon grain sensor data from the grain sensor nodes and is configured to calculate the predetermined minimum fan speed in terms of CFM/bushel of the amount of grain determined to be in the grain bin by the controller.

4. The equilibrium moisture grain drying system of claim 1, further comprising a user input device, and wherein the controller includes memory and is configured to store the predetermined minimum fan speed input via the user input device in the controller memory.

5. The equilibrium moisture grain drying system of claim 1, further comprising a pressure sensor located within the plenum, wherein the controller is configured to determine a relationship between pressure and airflow rates (CFM) through the grain bin, and wherein the controller is configured to increment the fan speed toward the predetermined minimum fan speed in terms of a desired airflow rate using pressure sensor data from the pressure sensor and the relationship to achieve the desired airflow rate corresponding to the predetermined minimum fan speed.

6. The equilibrium moisture grain drying system of claim 1, further comprising at least one grain temperature sensor within grain in the grain bin, wherein the grain temperature sensor is electronically coupled to the grain drying controller, and the grain drying controller receives grain temperature data from the grain temperature sensor and receives plenum air temperature data from the internal plenum temperature sensor, and in response to a temperature differential dT between the grain and plenum air temperature data being determined by the controller to be greater than a predetermined maximum dT, the grain drying controller is configured to adjust the variable speed fan to the predetermined minimum speed.

7. The equilibrium moisture grain drying system of claim 6, wherein the predetermined maximum dT is stored in controller memory and is about 10 degrees F.

8. The equilibrium moisture grain drying system of claim 1, further comprising at least one grain temperature sensor within grain in the grain bin, wherein the grain drying controller receives grain temperature data from the grain temperature sensor over a predetermined period of time, and in response to a temperature differential dT of grain temperature data received from the grain temperature sensor over the predetermined period of time being determined by the controller to exceed a predetermined maximum dT, the grain drying controller adjusts the variable speed fan to the predetermined minimum speed.

9. The equilibrium moisture grain drying system of claim 8, wherein the predetermined maximum dT and the predetermined time period is stored in controller memory and is about 10 degrees F. and about 24 hours, respectively.

10. The equilibrium moisture grain drying system of claim 1, wherein in response to a temperature differential dT between ambient temperature data from the ambient temperature sensor and plenum air temperature data from the internal plenum temperature sensor being determined by the controller to be greater than a predetermined maximum dT, the grain drying controller operates the variable speed fan at the predetermined minimum speed.

11. The equilibrium moisture grain drying system of claim 10, wherein the predetermined maximum dT is stored in controller memory and is between about 3 degrees F. and about 7 degrees F.

12. The equilibrium moisture grain drying system of claim 1, wherein a BTU output of the one of the heater and heat pump is variable, and the controller is configured to increment the BTU output to achieve target data from the internal plenum temperature sensor corresponding to the desired equilibrium moisture temperature.

13. The equilibrium moisture grain drying system of claim 1, wherein the controller is configured to incrementally increase the fan speed in response to the target equilibrium moisture temperature being above the plenum temperature data that is being received from the internal plenum temperature sensor, and is configured to incrementally decrease the fan speed in response to the target equilibrium moisture temperature being below the plenum temperature data that is being received from the internal plenum temperature sensor.

14. A process of operating an equilibrium moisture grain drying system including a grain drying controller coupled to each of a variable speed fan and one of a heater and a heat pump to supply air through an air plenum and through grain in a grain bin, an ambient temperature sensor each positioned outside the grain bin, an internal plenum temperature sensor positioned within the plenum, and a humidity sensor positioned outside the grain bin or within the plenum; the process comprises:

adjusting a fan speed of the variable speed fan in combination with operating the one of the heater and heat pump to achieve a reading from the internal plenum temperature sensor corresponding to a target equilibrium moisture temperature, during a first period in which the sensor data from the sensors positioned outside the grain bin indicate ambient air is outside the equilibrium moisture target, and the grain drying system is able to produce air in the plenum within the equilibrium moisture target from the ambient air outside the grain bin;

operating the variable speed fan at a predetermined minimum speed during a second period in which the sensor data from the sensors positioned outside the grain bin indicate ambient air outside the grain bin is outside the equilibrium moisture target, and the system is unable to produce air in the plenum within the equilibrium moisture target from the ambient air outside the grain bin in view of operational limits of the variable speed fan and the one of the heater and heat pump;

wherein, as the variable speed fan passes air within the equilibrium moisture target through the plenum and through the grain, the moisture content of grain in the grain bin moves toward a desired target grain moisture content corresponding to the equilibrium moisture target.

15. The process of operating the equilibrium moisture grain drying system of claim 14, further comprising:

the controller determining a relationship between pressure and airflow rates (CFM) through the grain bin; and the controller incrementing the fan speed toward the predetermined minimum fan speed in terms of a desired airflow rate using pressure sensor data from a pressure sensor and the relationship to achieve the desired airflow rate corresponding to the predetermined minimum fan speed.

16. The process of operating the equilibrium moisture grain drying system of claim 15, further comprising:

the controller operating the fan at a predetermined minimum fan speed that is stored within controller memory and is between about 0.07 CFM/Bushel and 1.4 CFM/Bushel of grain capacity in the grain bin.

17. The process of operating the equilibrium moisture grain drying system of claim 14, further comprising:

the controller receiving grain temperature data from at least one grain temperature sensor within grain in the grain bin; and the controller receiving plenum air temperature data from the internal plenum temperature sensor; and the controller determining whether a temperature differential dT between the received grain and plenum air temperature data is greater than a predetermined maximum dT and, if the temperature differential dT is greater than a predetermined maximum dT, the controller adjusting the variable speed fan to the predetermined minimum speed.

18. The process of operating the equilibrium moisture grain drying system of claim 17, further comprising:

storing in controller memory about 10 degrees F. as the predetermined maximum dT.

19. The process of operating the equilibrium moisture grain drying system of claim 14, further comprising:

the controller receiving grain temperature data from at least one grain temperature sensor within grain in the grain bin over a predetermined period of time; and the controller determining whether a temperature differential dT of grain temperature data received from the grain temperature sensor over the predetermined period of time exceeds a predetermined maximum dT and, if so, the controller adjusting the variable speed fan to the predetermined minimum speed.

20. The process of operating the equilibrium moisture grain drying system of claim 19, further comprising:

storing in controller memory about 10 degrees F. as the predetermined maximum dT and about 24 hours as the predetermined time period.

21. The process of operating the equilibrium moisture grain drying system of claim 14, further comprising:

the controller determining whether a temperature differential dT between ambient temperature data from the ambient temperature sensor and plenum air temperature data from the internal plenum temperature sensor is determined to be greater than a predetermined maximum dT, and if the temperature differential dT is greater than a predetermined maximum dT, the controller operating the variable speed fan at the predetermined minimum speed.

22. The process of operating the equilibrium moisture grain drying system of claim 21, further comprising:

storing a number in controller memory between about 3 degrees F. and about 7 degrees F. as the predetermined maximum dT.

23. The process of operating the equilibrium moisture grain drying system of claim 14, further comprising:

the controller incrementally increasing the fan speed in response to the target equilibrium moisture temperature being above the plenum temperature data that is being received from the internal plenum temperature sensor; and the controller incrementally decreasing the fan speed in response to the target equilibrium moisture temperature being below the plenum temperature data that is being received from the internal plenum temperature sensor.

24. The process of operating the equilibrium moisture grain drying system of claim 23, further comprising:

the controller incrementing the BTU output of the one of the heater and heat pump to achieve target data from the internal plenum temperature sensor corresponding to the desired equilibrium moisture temperature.

25. The process of operating the equilibrium moisture grain drying system of claim 14, further comprising:

positioning the humidity sensor outside the grain bin.

26. The process of operating the equilibrium moisture grain drying system of claim 14, further comprising:

positioning the humidity sensor within the plenum.

27. The equilibrium moisture grain drying system of claim 1, wherein the humidity sensor is an ambient humidity sensor positioned outside the grain bin.

28. The equilibrium moisture grain drying system of claim 1, wherein the humidity sensor is positioned within the plenum.

29. A process of operating an equilibrium moisture grain drying system including a grain drying controller coupled to each of a variable speed fan and one of a heater and a heat pump to supply air through an air plenum and through grain in a grain bin, an ambient air temperature or humidity sensor or both positioned outside the grain bin, an internal air temperature or humidity sensor or both positioned within the plenum; the process comprises:

operating the grain drying system to achieve a reading from the internal air temperature or humidity sensor corresponding to an equilibrium moisture target range, during a first period in which sensor data from the sensors positioned outside the grain bin indicate ambient air outside the grain bin is outside the equilibrium moisture target range, and the grain drying system is able to produce air in the plenum within the equilibrium moisture target from the ambient air outside the grain bin;

operating the grain drying system with the variable speed fan at a predetermined minimum speed during a second period in which sensor data from the sensors positioned outside the grain bin indicate ambient air outside the grain bin is outside the equilibrium moisture target, and the grain drying system is unable to produce air in the plenum within the equilibrium moisture target range from the ambient air outside the grain bin in view of operational limits of the variable speed fan and the one of the heater and heat pump;

wherein the operating the grain drying system during the first period produces air within the equilibrium moisture target range from the ambient air outside the grain bin, which air within the equilibrium moisture target range is supplied through the air plenum and through grain in the grain bin to move the moisture content of grain in the grain bin toward the desired target grain moisture content corresponding to the equilibrium moisture target range;

wherein the operating the grain drying system during the second period produces air outside the equilibrium moisture target range from the ambient air outside the grain bin, which air outside the equilibrium moisture target range is supplied through the air plenum and through grain in the grain bin.

30. The process of operating the equilibrium moisture grain drying system of claim 29, further comprising:

the controller determining a relationship between pressure and airflow rates (CFM) through the grain bin; and the controller incrementing the fan speed toward the predetermined minimum fan speed in terms of a desired airflow rate using pressure sensor data from a pressure sensor and the relationship to achieve the desired airflow rate corresponding to the predetermined minimum fan speed.

31. The process of operating the equilibrium moisture grain drying system of claim 30, further comprising:

the controller operating the fan at a predetermined minimum fan speed that is stored within controller memory and is between about 0.07 CFM/Bushel and 1.4 CFM/Bushel of grain capacity in the grain bin.

32. The process of operating the equilibrium moisture grain drying system of claim 29, further comprising:

the controller receiving grain temperature data from at least one grain temperature sensor within grain in the grain bin; and the controller receiving plenum air temperature data from the internal plenum temperature sensor; and the controller determining whether a temperature differential dT between the received grain and plenum air temperature data is greater than a predetermined maximum dT and, if the temperature differential dT is greater than a predetermined maximum dT, the controller adjusting the variable speed fan to the predetermined minimum speed.

33. The process of operating the equilibrium moisture grain drying system of claim 32, further comprising:

storing in controller memory about 10 degrees F. as the predetermined maximum dT.

34. The process of operating the equilibrium moisture grain drying system of claim 29, further comprising:

the controller receiving grain temperature data from at least one grain temperature sensor within grain in the grain bin over a predetermined period of time; and the controller determining whether a temperature differential dT of grain temperature data received from the grain temperature sensor over the predetermined period of time exceeds a predetermined maximum dT and, if so, the controller adjusting the variable speed fan to the predetermined minimum speed.

35. The process of operating the equilibrium moisture grain drying system of claim 34, further comprising:

storing in controller memory about 10 degrees F. as the predetermined maximum dT and about 24 hours as the predetermined time period.

36. The process of operating the equilibrium moisture grain drying system of claim 29, further comprising:

the controller determining whether a temperature differential dT between ambient temperature data from the ambient temperature sensor and plenum air temperature data from the internal plenum temperature sensor is determined to be greater than a predetermined maximum dT, and if the temperature differential dT is greater than a predetermined maximum dT, the controller operating the variable speed fan at the predetermined minimum speed.

37. The process of operating the equilibrium moisture grain drying system of claim 36, further comprising:

storing a number in controller memory between about 3 degrees F. and about 7 degrees F. as the predetermined maximum dT.

38. The process of operating the equilibrium moisture grain drying system of claim 29, further comprising:

the controller incrementally increasing the fan speed in response to the target equilibrium moisture temperature being no above the plenum temperature data that is being received from the internal plenum temperature sensor; and the controller incrementally decreasing the fan speed in response to the target equilibrium moisture temperature being below the plenum temperature data that is being received from the internal plenum temperature sensor.

39. The process of operating the equilibrium moisture grain drying system of claim 38, further comprising:

the controller incrementing the BTU output of the one of the heater and heat pump to achieve target data from the internal plenum temperature sensor corresponding to the desired equilibrium moisture temperature.

* * * * *